US007730670B2

(12) United States Patent
Whitaker

(10) Patent No.: US 7,730,670 B2
(45) Date of Patent: Jun. 8, 2010

(54) SLIDING DOOR ASSEMBLY

(75) Inventor: Thomas M. Whitaker, New Canaan, CT (US)

(73) Assignee: Mr. Shower Door, Inc., Norwalk, CT (US)

( * ) Notice: Subject to any disclaimer, the term of this patent is extended or adjusted under 35 U.S.C. 154(b) by 742 days.

(21) Appl. No.: 11/068,706

(22) Filed: Mar. 1, 2005

(65) Prior Publication Data

US 2006/0207184 A1 Sep. 21, 2006

(51) Int. Cl.
*E05D 13/00* (2006.01)

(52) U.S. Cl. ..... 49/409; 49/425; 16/87 R; 16/91

(58) Field of Classification Search ..... 49/409, 49/425; 16/87 R, 90, 91, 94 R, 97; 4/614, 4/557

See application file for complete search history.

(56) References Cited

U.S. PATENT DOCUMENTS 3,041,657 A * 7/1962 McNinch ..... 16/105
3,653,157 A 4/1972 Casebolt ..... 49/411
3,808,633 A * 5/1974 Lauterbach ..... 16/87 R
4,014,377 A * 3/1977 Kochanowski ..... 160/186
4,178,718 A * 12/1979 Laby ..... 49/411
4,256,164 A * 3/1981 Agcaoili ..... 160/186
4,833,829 A * 5/1989 Wilson ..... 49/426
4,887,394 A 12/1989 Marlowe ..... 49/409
5,123,128 A 6/1992 Hines ..... 4/557
5,404,675 A 4/1995 Schmidhauser ..... 49/409
5,450,693 A * 9/1995 Tarrega ..... 49/411
5,598,666 A * 2/1997 Kurth ..... 49/409
5,613,276 A 3/1997 Franz ..... 16/229
6,052,867 A * 4/2000 Haab et al. ..... 16/87.6 R
6,185,784 B1 * 2/2001 Gamperle ..... 16/99
6,381,904 B1 * 5/2002 Tedescucci ..... 49/409
6,427,286 B1 * 8/2002 Erskine ..... 16/96 R
6,460,218 B2 * 10/2002 Zingg ..... 16/105

* cited by examiner

*Primary Examiner*—Jerry Redman
(74) *Attorney, Agent, or Firm*—St. Onge Steward Johnston & Reens, LLC

(57) ABSTRACT

An assembly for coupling a sliding door to a track is disclosed generally comprising a support member, which has a channel in which an upper portion of the panel is disposed, that is connected to an engagement device, such as a wheel, adapted to engage the track. The engagement device is fastened to the support member at a point adjacent to the upper portion of panel in order to minimize the vertical space required. In some embodiments, the panel has a gap in the upper portion, and the engagement device is fastened to the support member via a fastener that extends through the support member and the gap in the panel. In certain embodiments, the support member is a shoe with first and second sidewalls. In some of these embodiments, the fastener extends through the engagement device and into the first sidewall adjacent the panel.

20 Claims, 6 Drawing Sheets

SLIDING DOOR ASSEMBLY

FIELD OF THE INVENTION

The present invention relates to an assembly for sliding panels, such as shower doors. More specifically, the invention relates to an assembly for coupling a sliding panel to the track portion of a low-profile frame.

BACKGROUND OF THE INVENTION

Systems for assembling sliding panels, such as the type commonly used in shower doors, are generally well known in the art. Typically, some sort of free standing enclosure or frame extending from the walls of the dwelling structure are employed to surround an area that can then be easily accessed via the use of a sliding door housed within that frame. Usually, an upper, horizontal frame member, header, or slider rail will be used to guide and/or support one or more sliding door panels, the upper portions of which will often hang from the frame member. In some of these arrangements, a lower track or guide member is present in a lower part of the frame in order to keep the door panel from moving laterally as it slides longitudinally along the upper frame member. Examples of such systems are disclosed in U.S. Pat. No. 3,653,157 to Casebolt and U.S. Pat. No. 5,450,693 to Tarrega.

In order facilitate the sliding of the door, the top frame member usually includes a track, and the door includes a device that is adapted to engage the track, such as a wheel or roller of some sort. Because the door is connected to the wheel, these systems allow one to simply push the door, which will then slide with the wheel as it moves along the track in the upper frame member.

However, one problem with these systems is that they require mechanisms for both holding the door panel and connecting it to the wheel that engages the track. Therefore, these arrangements typically employ some sort of connection device for clamping the upper portion of the door panel or being otherwise fastened to the door, which connection device can then be connected to the wheel, such as in the arrangements disclosed in U.S. Pat. No. 4,887,394 to Marlowe and U.S. Pat. No. 5,123,128 to Hines.

These arrangements, however, result in a significant disadvantage. By employing these connecting mechanisms, additional vertical space is required, resulting in an upper frame member with a large profile. First, such designs result in extra costs associated with manufacturing these unnecessarily large headers. Additionally, however, such designs simultaneously increase the size of the header while decreasing the size of the space created by sliding open the door, thereby resulting in an undesirably low level of aesthetic appeal and a decrease in the amount of open space by which one can access the enclosed area.

Alternatively, a hole may be drilled through the door panel itself, and the wheel may be fastened to the panel through this hole. However, sliding doors, and in particular, shower doors, are often made of glass. In addition to the infirmities produced by creating a weight bearing aperture in the glass, such holes must be created a significant distance below the top of the door panel, as apertures too close to the top edge of the door will be too weak and will result in fractures. Accordingly, a fair amount of glass must extend upwards from the point at which the door panel is fastened to the wheel, again necessitating a header with an undesirably large profile.

What is desired, therefore, is a sliding door assembly that does not require the use of headers that are expensive to manufacture. What is further desired is a sliding door assembly that minimizes the size of the header and maximizes the space created by sliding open the door. What is also desired is a sliding door assembly that does not create weaknesses in the glass of glass doors.

SUMMARY OF THE INVENTION

Accordingly, it is an object of the present invention to provide a sliding door assembly that securely fastens a panel to an engagement device for engaging the track of a frame.

It is a further object of the present invention to provide a sliding door assembly that employs a connection mechanism for connecting the track engagement device to the panel that does not require excessive vertical space.

It is yet another object of the present invention to provide a sliding door assembly that does not fasten the track engagement device directly to the panel via an opening in the panel.

In order to overcome the deficiencies of the prior art and to achieve at least some of the objects and advantages listed, the invention comprises an assembly for coupling a sliding panel to a track, including a support member having a channel therein, a panel having an upper portion disposed in the channel of the support member, the upper portion of the panel having a gap therein, an engagement device adapted to engage the track, and a fastener securing the engagement device to the support member, the fastener extending through at least part of the support member and the gap in the upper portion of the panel.

In some of these embodiments, the support member comprises a shoe having first and second sides, and the fastener extends through the first side of the shoe, through the gap in the upper portion of the shower door, through the second side of the shoe, and through the wheel.

In another embodiment, the invention comprises an assembly for coupling a sliding panel to a track, including a support member having first and second sidewalls at least partially defining a channel therebetween, a panel having an upper portion disposed in the channel of the support member, an engagement device adapted to engage the track, and a fastener securing the engagement device to the support member, the fastener extending into the first sidewall of the support member adjacent to the panel.

In yet another embodiment, the invention comprises a sliding door assembly, including a frame member having a track, an engagement device coupled to the track, a support member having a channel therein, a panel having an upper portion disposed in the channel of the support member, the upper portion of the panel having a gap therein, and a fastener securing the engagement device to the support member, the fastener extending through at least part of the support member and the gap in the upper portion of the panel.

In still another embodiment, the invention comprises a sliding door assembly, including a frame member having a track, an engagement device coupled to the track, a support member having first and second sidewalls at least partially defining a channel therebetween, a panel having an upper portion disposed in the channel of the support member, and a fastener securing the engagement device to the support member, the fastener extending into the first sidewall of the support member adjacent to the panel.

DETAILED DESCRIPTION OF THE DRAWINGS

Figure 1:
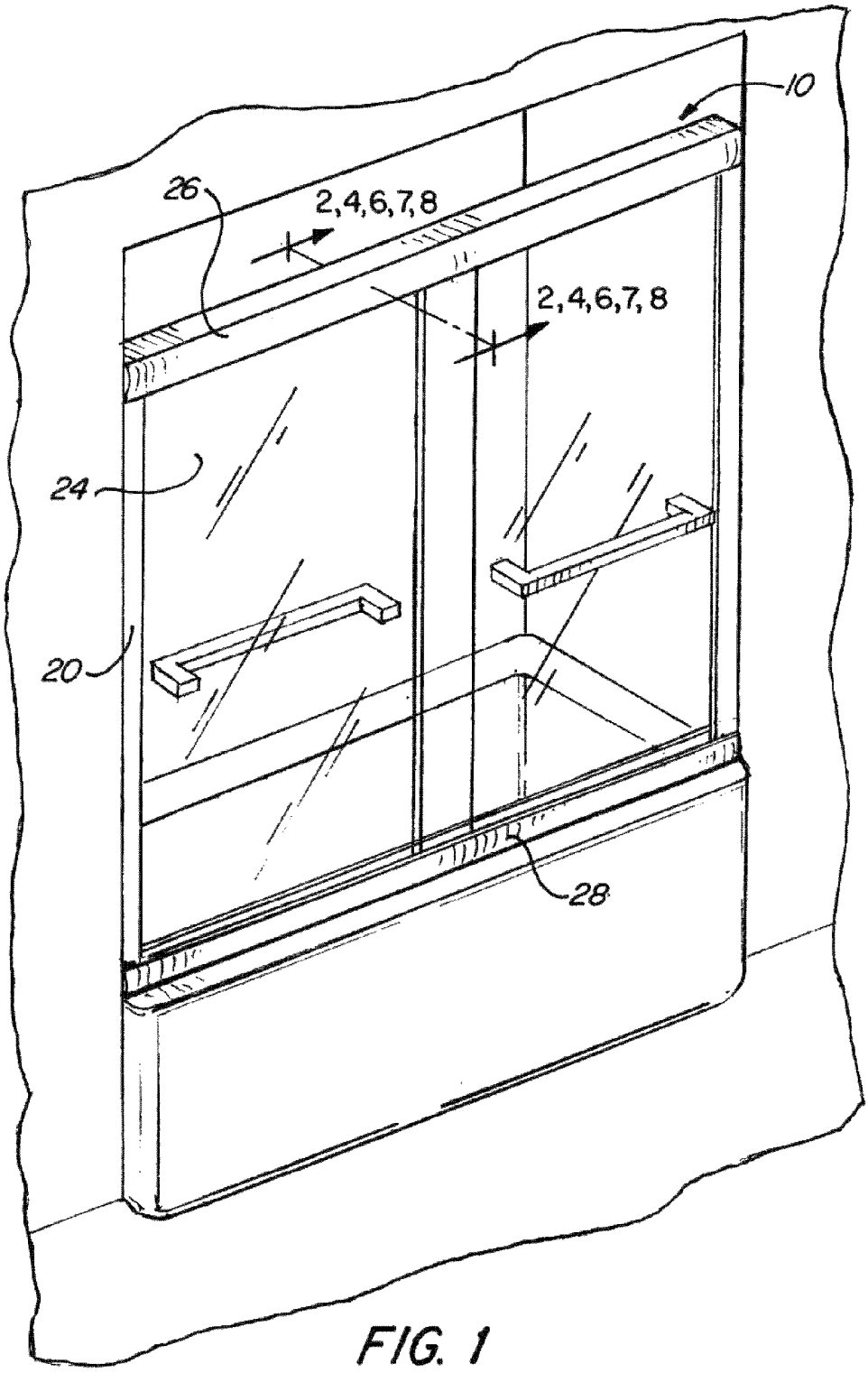
FIG. 1 is an isometric view of a sliding door assembly in accordance with the invention.

The basic components of one embodiment of a sliding door assembly in accordance with the invention are illustrated in FIG. 1. As used in the description, the terms "top," "bottom," "above," "below," "over," "under," "above," "beneath," "on top," "underneath," "up," "down," "upper," "lower," "front," "rear," "back," "forward" and "backward" refer to the objects referenced when in the orientation illustrated in the drawings, which orientation is not necessary for achieving the objects of the invention.

The assembly 10 includes a frame 20 that houses at least one door panel 24. The frame has an upper, horizontal frame member 26, further described below, and a lower, horizontal frame member 28, which includes a track or guide rail (not shown) for stabilizing the panel 24 and preventing it from moving laterally as it slides longitudinally along the length of the upper and lower frame members 26, 28.

Figure 2:
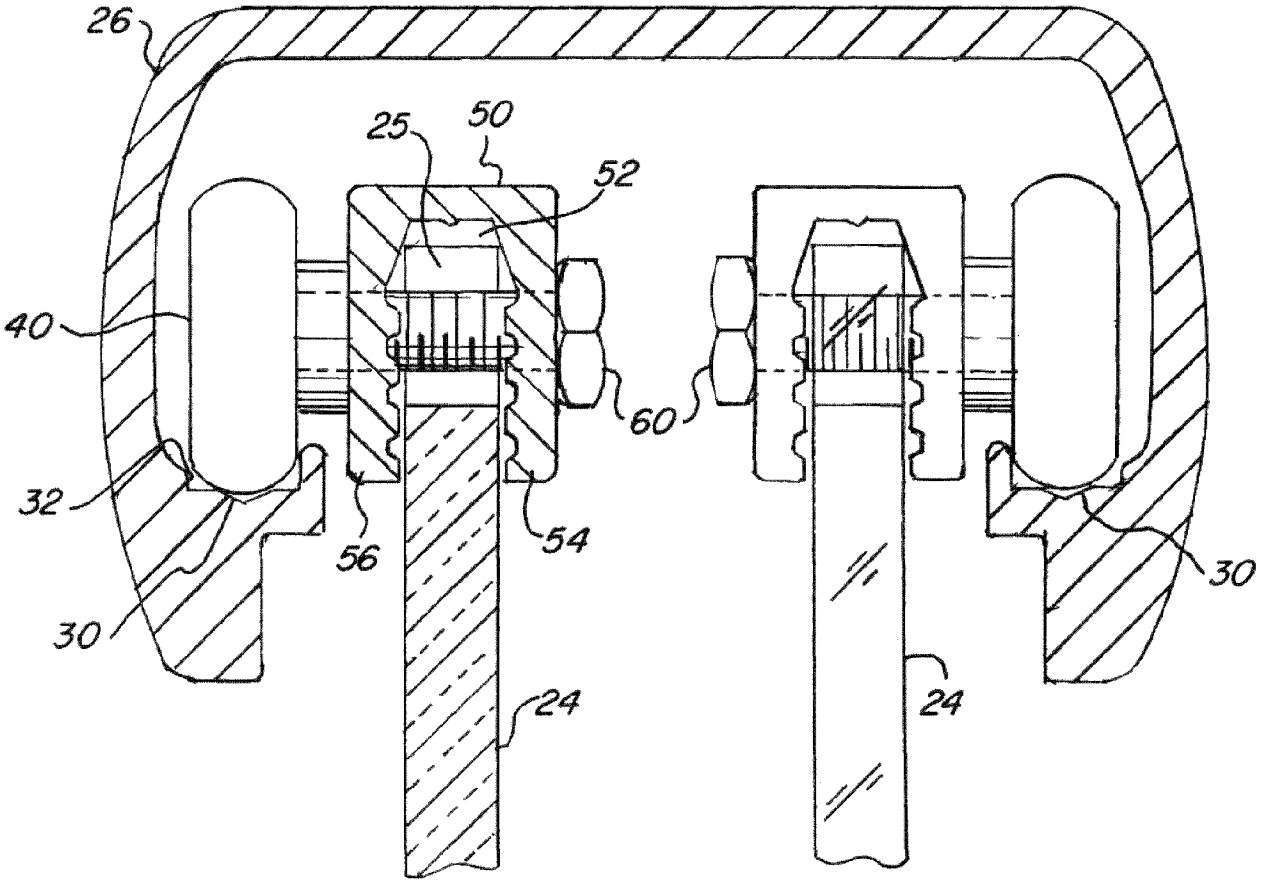
FIG. 2 is an end view in partial cross-section showing additional detail of the sliding door assembly of FIG. 1.

As shown in more detail in FIG. 2, the upper frame member 26 includes a track 30. Though described in the singular herein, the frame member 26 may include a plurality of tracks 30 and panels 24, as illustrated in FIG. 2.

An engagement device 40 that is adapted to engage the track 30 is at least partially disposed in or on the track 30. For example, in certain advantageous embodiments, the engagement device is a wheel that rolls along the track 30. In some of these embodiments, the track 30 includes a recess 32 in which the wheel 40 is partially disposed. As a result, the wheel 40 remains securely in the track 30 as it rolls.

The wheel 40 is fastened to a support member 50, to which the door panel 24 is, in turn, secured. The wheel 40 is fastened to support member 50 at a point adjacent to the upper portion of the panel 24, thereby minimizing the amount of space required above the top of the panel 24. The support member 50 has a channel 52 therein, and the upper portion 25 of the panel 24 is disposed in the channel 52. In certain advantageous embodiments, this support member is a shoe having first and second sides 54, 56, which serves as a clamp on the upper portion of the panel 24.

Figure 3:
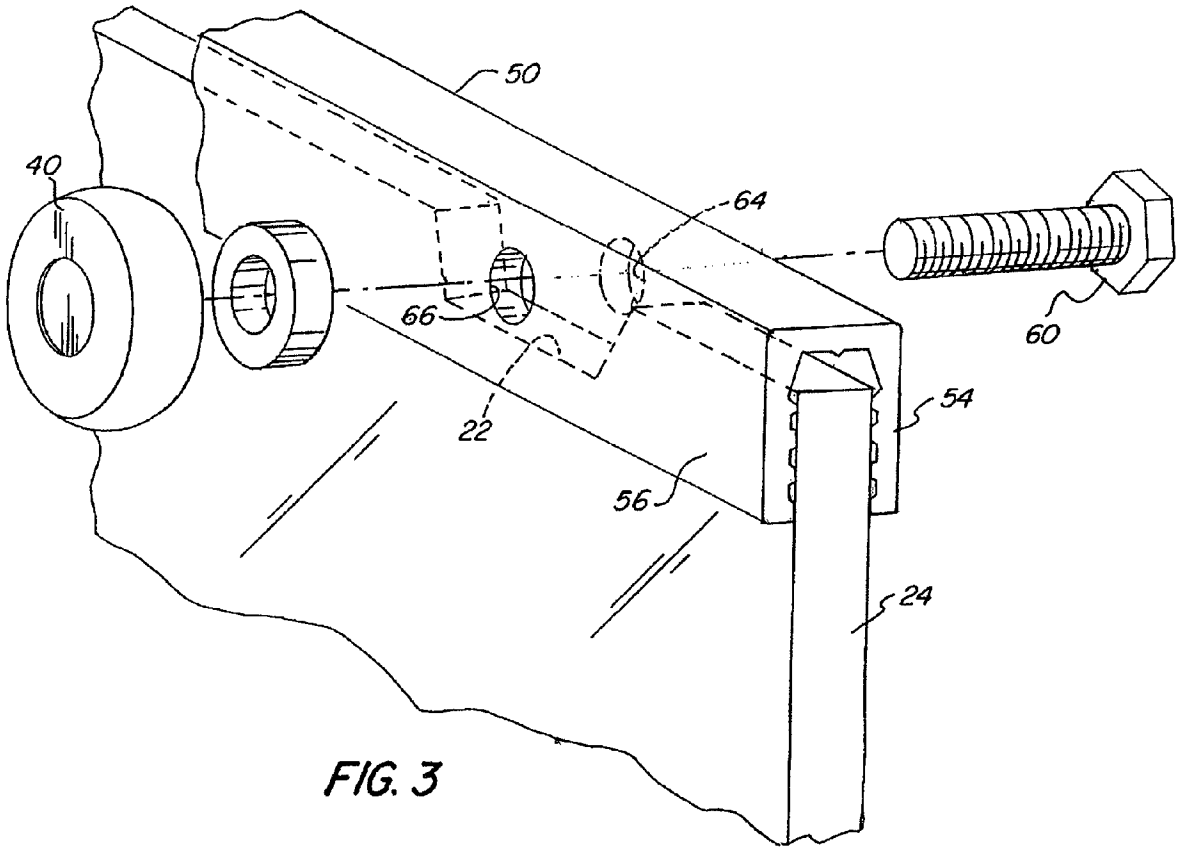
FIG. 3 is an isometric view showing additional detail of the sliding door assembly of FIG. 1.

As illustrated in FIG. 3, the wheel 40 is fastened to the support member 50 via a fastener 60. The panel 24 has a gap 22, and the first and second sides 54, 56 of the shoe 50 have apertures 64, 66, respectively, adjacent to the gap 22. Accordingly, the fastener 60, which may, for example, be a threaded screw, passes through the first side 54 via the aperture 64, through the gap 22, through the second side 56 via the aperture 66, and into the wheel 40. In this way, the wheel 40 can be fastened to support member 50 at a point very close to the top of the panel 24, thereby permitting a very low profile frame member 26 (FIG. 1) to be used. Though the fastener 60 is illustrated as terminating at the wheel 40, the fastener 60 may be inserted into the assembly from the opposite direction than that shown, such that the fastener 60 is first inserted into the wheel 40, then the second side 56, then gap 22, and finally the first side 54. Additionally, a nut or similar device (not shown) may be employed to further secure the fastener 60 in the assembly.

Figure 4:
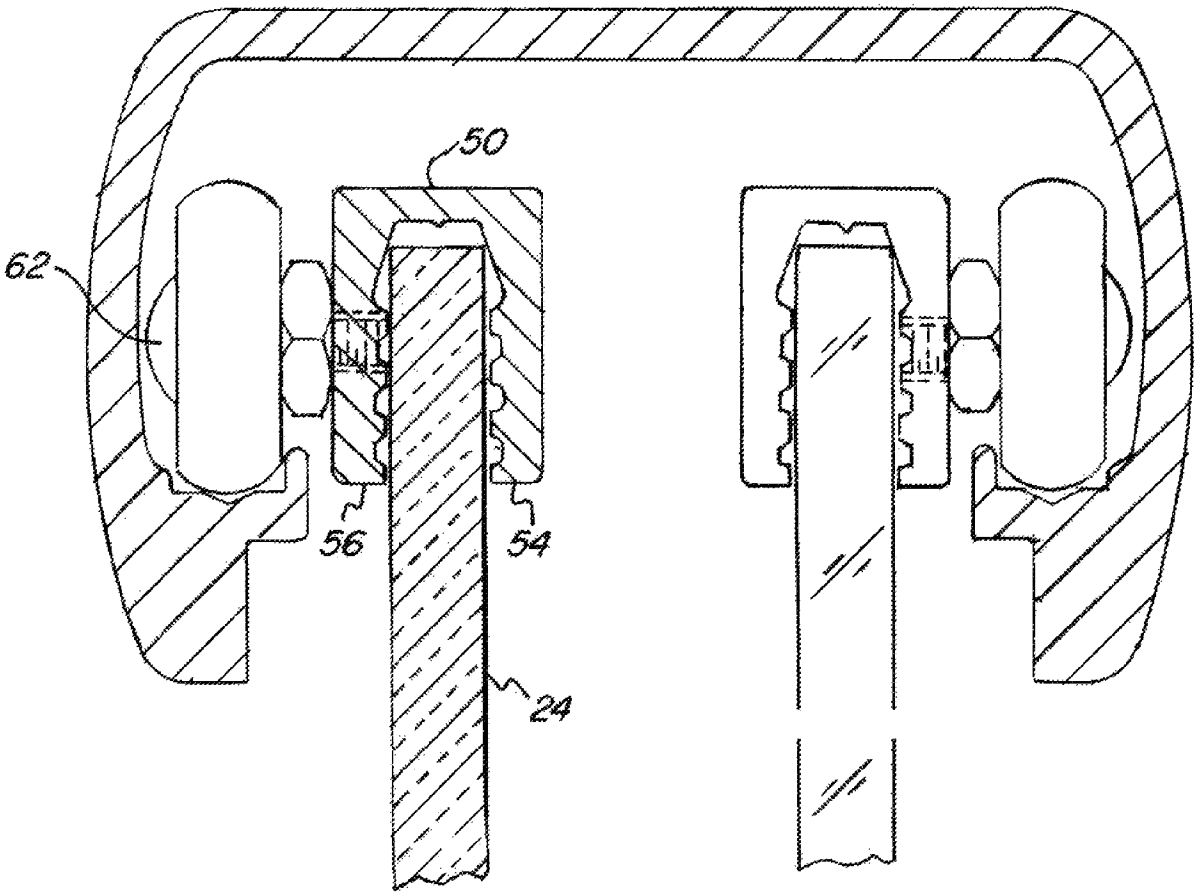
FIG. 4 is an end view in partial cross-section showing additional detail of the sliding door assembly of FIG. 1.
Figure 5:
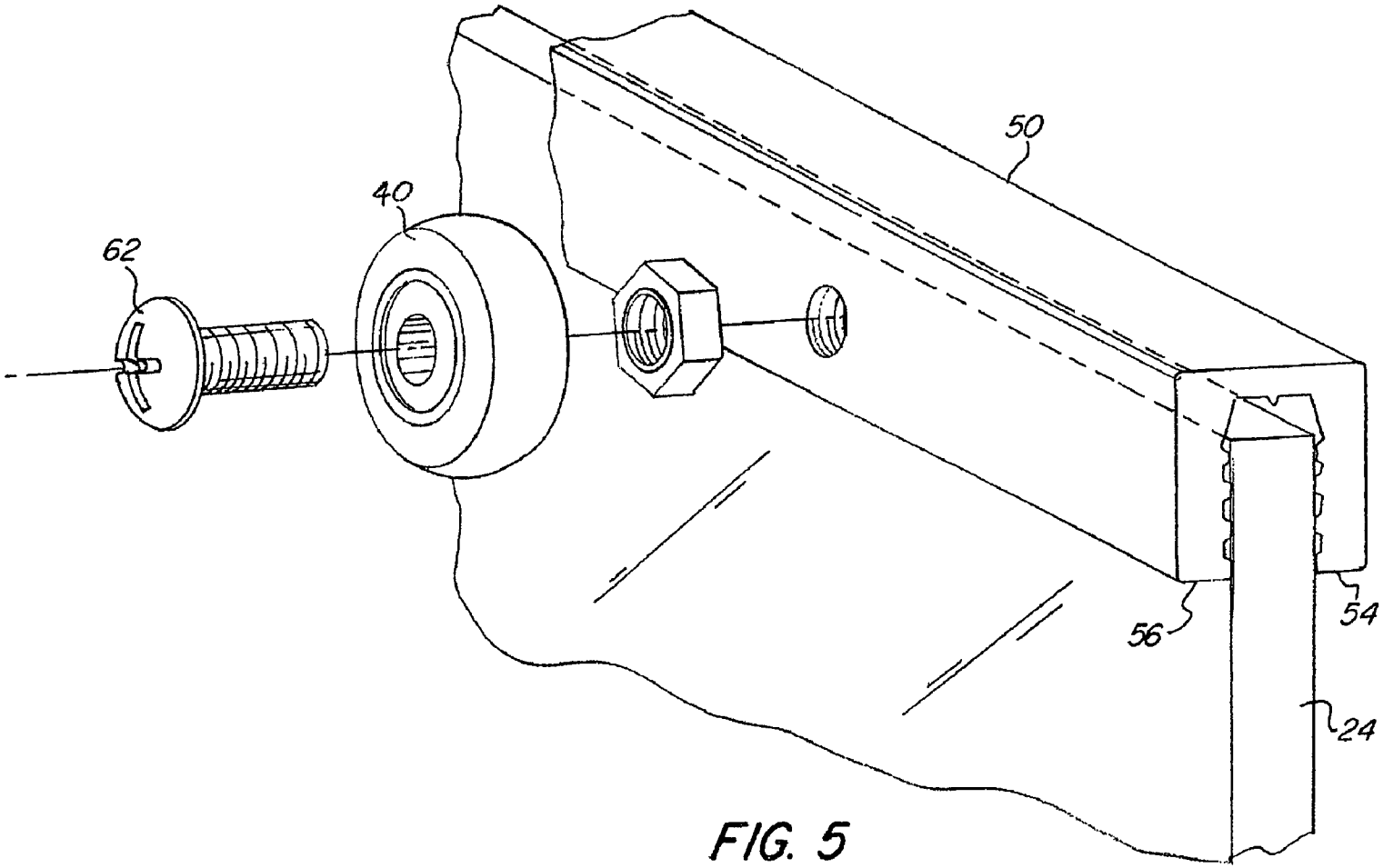
FIG. 5 is an isometric view showing additional detail of the sliding door assembly of FIG. 1.

As described above, in certain advantageous embodiments, the support member 50 includes a usually metallic shoe with sidewalls 54, 56, which at least partially define the channel 52 therebetween, for clamping the panel 24. In some of these embodiments, the sidewalls 54, 56 of the shoe 50 with the panel 24 disposed therebetween provides a rigid enough structure that the sidewall 56 is sufficient to support the connection of the shoe 50 to the wheel 40. Accordingly, as illustrated in FIGS. 4-5, in these embodiments, a fastener 62 is inserted through the wheel 40 and into the sidewall 56 of the shoe 50, and thus, no gap in the panel 24 is required for accommodating the fastener. Because the fastener 62 is inserted into the sidewall 56 adjacent to the upper portion 25 of the panel 24, rather than being located above the top of the panel 24, the amount of space required above the top of the panel 24 is minimal.

Figure 6:
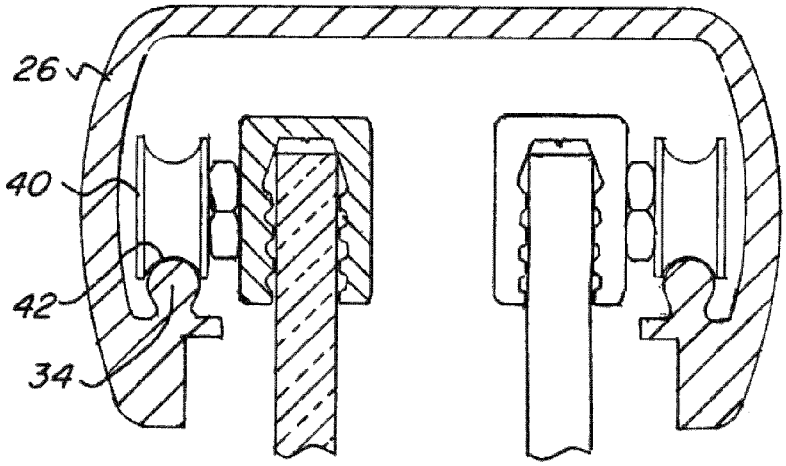
FIG. 6 is an end view in partial cross-section showing additional detail of the sliding door assembly of FIG. 1.

Though the engagement device 40 has been described as a wheel partially disposed in a recess 32 of the track 30, in other embodiments, other arrangements are employed. For example, as shown in FIG. 6, the track 30 may comprise a protuberance 34, and the wheel 40 may include a recess 42 corresponding to the shape of the protuberance 34 so that it rolls thereon.

Figure 7:
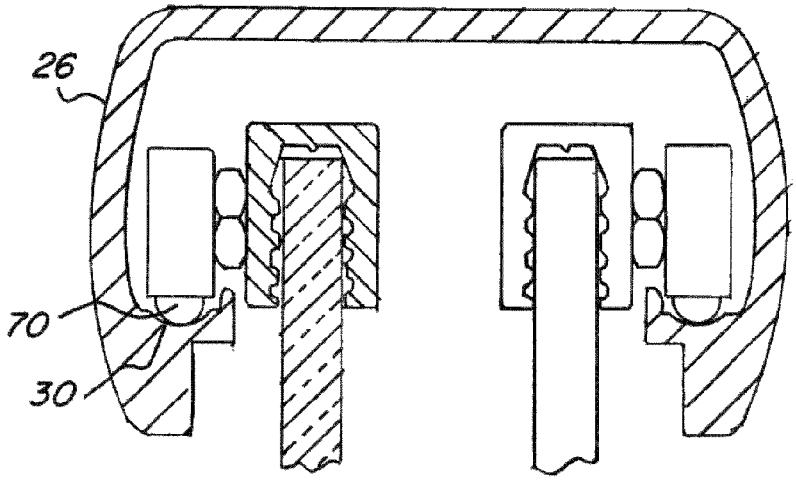
FIG. 7 is an end view in partial cross-section showing additional detail of the sliding door assembly of FIG. 1.
Figure 8:
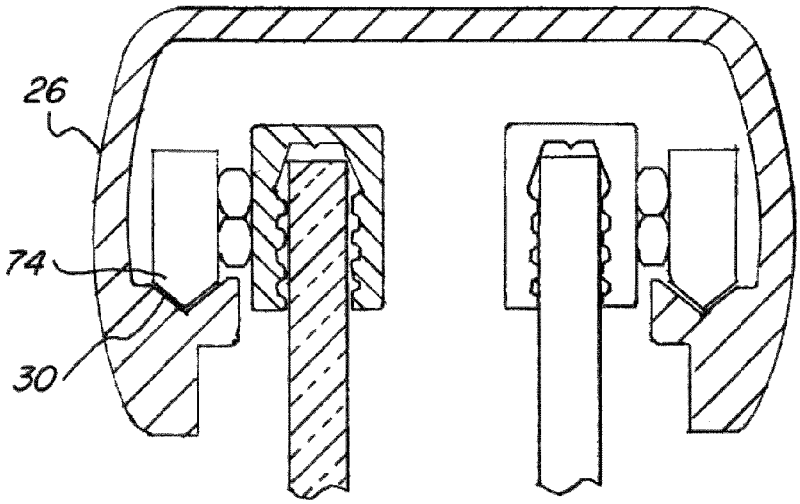
FIG. 8 is an end view in partial cross-section showing additional detail of the sliding door assembly of FIG. 1.

Similarly, in certain embodiments, engagement devices other than a wheel are used to facilitate movement along the upper frame member 26. For example, as illustrated in FIG. 7, the engagement device 40 may include a bearing, such as a ball bearing 70, adapted to rotate as the device 40 moves along the length of the track 30. As another example, as shown in FIG. 8, the engagement device 40 may simply comprise a sliding member 74 with a low friction surface corresponding to the shape of the track 30 and adapted to slide along it as the panel 24 is pushed longitudinally along the length of the frame member 26.

It should be understood that the foregoing is illustrative and not limiting, and that obvious modifications may be made by those skilled in the art without departing from the spirit of the invention. Accordingly, reference should be made primarily to the accompanying claims, rather than the foregoing specification, to determine the scope of the invention.

What is claimed is:

1. A sliding panel assembly, comprising:

a support member having first and second sidewalls at least partially defining a channel therebetween;

a panel having a first side surface, a second side surface, and a top surface with a notch that extends down from the top surface, wherein an upper portion of said panel is disposed in the channel of said support member such that the first side surface is at least partially in contact with the first sidewall, the second side surface is at least partially in contact with the second sidewall, and the notch is enclosed within the channel between the first and second sidewalls of said support member;

a track engagement device; and a fastener securing said track engagement device to said support member, said fastener extending through the first sidewall of said support member, past the first side surface of said panel, through the channel in which the upper portion of the panel is disposed, through the notch in the top surface of said panel, past the second side surface of said panel, and through the second sidewall of said support member.

2. An assembly as claimed in claim 1, wherein said panel comprises a shower door.

3. An assembly as claimed in claim 1, wherein said engagement device comprises a wheel.

4. An assembly as claimed in claim 1, wherein said engagement device comprises a rotating bearing.

5. An assembly as claimed in claim 1, wherein said engagement device comprises a sliding member.

6. An assembly as claimed in claim 1, wherein said support member comprises a shoe having first and second sides, and wherein said fastener extends through the first side of said shoe, through the recess in the top surface of said panel, through the second side of said shoe, and through said engagement device.

7. A shower door assembly, comprising:

a support member having first and second sidewalls at least partially defining a channel therebetween;

a shower door panel having an upper portion disposed in the channel of said support member such that a first side surface of said shower door panel is at least partially in contact with the first sidewall and a second side surface of said shower door panel is at least partially in contact with the second sidewall;

a wheel; and a fastener securing said wheel to said support member, said fastener extending into the first sidewall of said support member adjacent to said shower door panel without extending into said panel and without extending past the first side surface of said panel, wherein said fastener is at least partially below a top surface of the upper portion of said shower door panel.

8. An assembly as claimed in claim 7, wherein said support member comprises a metal shoe.

9. An assembly as claimed in claim 8, wherein said shower door panel comprises glass.

10. A sliding door assembly, comprising:

a frame member having a track;

an engagement device coupled to the track;

a support member having first and second sidewalls at least partially defining a channel therebetween;

a panel having an upper portion disposed in the channel of said support member such that a first side surface of said panel is at least partially in contact with the first sidewall and a second side surface of said panel is at least partially in contact with the second sidewall; and a fastener securing said engagement device to said support member, said fastener extending into the first sidewall of said support member adjacent to said panel without extending into said panel and without extending past the first side surface of said panel, wherein said fastener is at least partially below a top surface of the upper portion of said shower door panel.

11. The assembly as claimed in claim 10, wherein said panel comprises a shower door.

12. An assembly as claimed in claim 10, wherein the track includes a recess, and said engagement device is at least partially disposed in the recess.

13. An assembly as claimed in claim 10, wherein said engagement device comprises a wheel.

14. An assembly as claimed in claim 13, wherein the track includes a protrusion, and said wheel has a recess therein for engaging the protrusion.

15. The assembly as claimed in claim 10, wherein said engagement device comprises a bearing adapted to rotate as the engagement device moves along the track.

16. The assembly as claimed in claim 10, wherein said engagement device comprises a sliding member adapted to slide along the track.

17. An assembly as claimed in claim 10, wherein said support member comprises a metal shoe.

18. An assembly as claimed in claim 17, wherein said shower door panel comprises glass.

19. A sliding door assembly, comprising:

a frame member having a track;

an engagement device coupled to the track;

a support member having first and second sidewalls at least partially defining a channel therebetween a panel having a first side surface, a second side surface, and a top surface with a notch that extends down from the top surface, wherein an upper portion of said panel is disposed in the channel of said support member such that the first side surface is at least partially in contact with the first sidewall, the second side surface is at least partially in contact with the second sidewall, and the notch is enclosed within the channel between the first and second sidewalls of said support member;

a fastener securing said engagement device to said support member, said fastener extending through the first sidewall of said support member, past the first side surface of said panel, through the channel in which the upper portion of the panel is disposed, through the notch in the top surface of said panel, past the second side surface of said panel, and through the second sidewall of said support member.

20. An assembly as claimed in claim 19, wherein said support member comprises a shoe having first and second sides, and wherein said fastener extends through the first side of said shoe, through the recess in the top surface of said panel, through the second side of said shoe, and through said engagement device.

* * * * *